US007741261B1

(12) United States Patent
Guerrero

(10) Patent No.: US 7,741,261 B1
(45) Date of Patent: Jun. 22, 2010

(54) COMPOSITION FOR ALL NATURAL CLEANING PRODUCTS

(76) Inventor: Ivania Guerrero, 22461 Seabass Dr., Boca Raton, FL (US) 33428

( * ) Notice: Subject to any disclaimer, the term of this patent is extended or adjusted under 35 U.S.C. 154(b) by 0 days.

(21) Appl. No.: 12/455,421

(22) Filed: Jun. 2, 2009

(51) Int. Cl.
*C11D 3/22* (2006.01)
*C11D 3/43* (2006.01)
*C11D 3/50* (2006.01)

(52) U.S. Cl. ..... 510/179; 510/181; 510/182; 510/417; 510/437; 510/474

(58) Field of Classification Search ..... 510/179, 510/181, 182, 417, 437, 474
See application file for complete search history.

(56) References Cited

FOREIGN PATENT DOCUMENTS

WO WO 2009/029046 * 3/2009

* cited by examiner

*Primary Examiner*—Brian P Mruk
(74) *Attorney, Agent, or Firm*—Robert M. Downey, P.A.

(57) ABSTRACT

A cleaning composition contains all natural ingredients and is both environmentally safe and hypoallergenic. One embodiment of natural glass cleaner contains white vinegar, natural aloe vera gel, fresh rosemary, filtered water, pure eucalyptus oil, lauryl glucoside, green food color, and a preservative. One embodiment of natural scrub wash multi-purpose cleaner contains lemon juice, fresh rosemary, lauryl glucoside, filtered water, fresh peppermint and a preservative. One embodiment of natural shine furniture cleaner contains lemon juice, extra virgin olive oil, pure orange oil, pure lemon oil, pure eucalyptus oil, filtered water, and a preservative.

12 Claims, No Drawings

COMPOSITION FOR ALL NATURAL CLEANING PRODUCTS

BACKGROUND OF THE INVENTION

1. Field of the Invention

The present invention relates to cleaning compositions and, more particularly, to compositions containing natural ingredients having good cleaning properties and which are both environmentally safe and hypoallergenic. In one embodiment, the present invention relates to cleaning compositions for use on glass surfaces. In a second embodiment, the present invention relates to cleaning compositions for use on furniture surfaces. In a third embodiment, the present invention relates to general purpose cleaning compositions to be used on hard surfaces.

2. Discussion of the Related Art

The development and progression of cleaning formulations has always been focused on meeting the demands of the consumer. In the interest of always improving on previous cleaning formulations, most cleaners have, in the past, been created using an increasing number of synthetic surfactants and solvents. While such synthetically formulated cleaners can be extremely effective at killing germs and cleaning surfaces, they also pose a significant danger to the consumer and the local environment. Many chemicals found in homes have been linked to allergies, cancer, birth defects and psychological abnormalities. Millions of pounds of these toxic ingredients are poured down drains each day and are not adequately removed by water treatment. These ingredients are returned to rivers and other water sources from which drinking water is obtained. The use of synthetic surfactants and solvents continues to leave consumers and the environment suffering the health consequences.

Because of the significant dangers posed by synthetic cleaners and the ever increasing desire for renewable resources, there has been an increased demand for entirely natural cleaning compositions. However, in the past, natural based cleaning compositions have suffered from at least one of two shortcomings. Firstly, many such compositions have used all natural ingredients but failed to perform at the level of synthetically composed cleaners, forcing consumers to choose between their health and effective cleaning. Secondly, many other of such compositions have achieved similar performance to that of the synthetically composed cleaners but only use several natural ingredients in combination with several synthetic surfactants and solvents. Compositions of this type merely slow and reduce the negative health and environmental effects of the toxic ingredients as opposed to eliminating them altogether.

Prior art compositions fail to combine entirely natural compositions with effective cleaning that can be competitive with synthetic cleaners. Accordingly, there is an immediate need for a more effective natural cleaning composition which can compete with the top synthetic cleaners in terms of cleaning effectiveness and which can also be composed of almost entirely natural ingredients.

SUMMARY OF THE INVENTION

Before proceeding with the summary of the present invention, it is to be understood that unless otherwise stated, all percentages ("%'s") given are to be taken as percentage of total volume (percent by volume) of the entire composition (based on 100% active) including substrate volume. As an example, an embodiment containing 95% filtered water would have 95 mL of filtered water contained in every 100 mL of composition.

The present invention is directed to an all natural cleaning composition which is both environmentally safe and hypoallergenic. One embodiment of the present invention comprises a natural glass cleaning composition consisting essentially of 0.25 to 0.75% white vinegar; 0.15 to 0.35% natural aloe vera gel; 0.5 to 1% fresh rosemary; 0.015 to 0.035% pure eucalyptus oil; 0.015 to 0.035% lauryl glucoside; filtered water; and optionally dyes, colorants and preservatives.

A second embodiment of the present invention comprises a natural glass cleaning composition consisting essentially of 0.005 to 0.01% natural essential rosemary oil; 0.005 to 0.01% natural essential jasmine oil; 0.015 to 0.035% lauryl glucoside; filtered water; and optionally dyes, colorants and preservatives.

A third embodiment of the present invention comprises a natural glass cleaning composition consisting essentially of 0.015 to 0.035% white vinegar; 0.015 to 0.035% fresh aloe vera gel; 0.1 to 0.2% fresh rosemary; 0.025 to 0.05% natural lavender oil; 0.015 to 0.035% lauryl glucoside; filtered water; and optionally dyes, colorants and preservatives.

A fourth embodiment of the present invention comprises a natural scrub wash multi-purpose cleaning composition consisting essentially of 1 to 2% lemon juice; 2.5 to 3.5% fresh rosemary; 1 to 2% lauryl glucoside; 0.5 to 1% fresh peppermint; filtered water; and optionally dyes, colorants and preservatives.

A fifth embodiment of the present invention comprises a natural shine furniture cleaning composition consisting essentially of 2.5 to 3% lemon juice; 1.5 to 2% extra virgin olive oil; 0.5 to 1% pure orange oil; 0.5 to 1% pure lemon oil; 0.5 to 1% pure eucalyptus oil; filtered water; and optionally dyes, colorants and preservatives.

A sixth embodiment of the present invention comprises a natural shine furniture cleaning composition consisting essentially of 5 to 6% lemon juice; 2.5 to 3% extra virgin olive oil; 0.5 to 1% natural essential lavender oil; filtered water; and optionally dyes, colorants and preservatives.

OBJECTS AND ADVANTAGES OF THE INVENTION

Considering the foregoing, it is a primary object of the present invention to provide a cleaning composition composed of no less than 99.95% natural ingredients.

It is a further object of the present invention to provide a cleaning composition composed of no less than 99.95% natural ingredients which is environmentally safe during storage, after application and after disposal.

It is still a further object of the present invention to provide a cleaning composition as described above which is hypoallergenic.

It is still a further object of the present invention to provide a cleaning composition as described above which is healthy to be inhaled or absorbed on the skin without causing negative health effects such as cancer, allergies, birth defects or psychological abnormalities.

It is still a further object of the present invention to provide an embodiment of the cleaning composition detailed above containing eucalyptus, aloe and rosemary for the purpose of cleaning glass surfaces.

It is still a further object of the present invention to provide an embodiment of the cleaning composition detailed above containing rosemary and jasmine for the purpose of cleaning glass surfaces.

It is still a further object of the present invention to provide an embodiment of the cleaning composition detailed above containing lavender, aloe and rosemary for the purpose of cleaning glass surfaces.

It is still a further object of the present invention to provide an embodiment of the cleaning composition detailed above as a natural scrub wash intended for use as a multi-purpose cleaner.

It is still a further object of the present invention to provide an embodiment of the cleaning composition detailed above containing eucalyptus for the purpose of cleaning and shining furniture surfaces.

It is still a further object of the present invention to provide an embodiment of the cleaning composition detailed above containing lavender for the purpose of cleaning and shining furniture surfaces.

It is still a further object of the present invention to provide several embodiments of a cleaning composition as detailed above which can be competitive with the leading synthetically manufactured surface cleaning compositions.

It is still a further object of the present invention to provide several embodiments of a cleaning composition as detailed above wherein the composition has a pleasant scent and contributes to the shine and pleasant appearance of a surface.

These and other objects of the present invention are more readily apparent with reference to the detailed description which follows.

DETAILED DESCRIPTION OF THE PREFERRED EMBODIMENTS

Before describing the present invention in detail, it is to be understood that the terminology used herein is for the purpose of describing particular embodiment of the invention only, and is not intended limit the spirit or scope of the invention in any manner.

Unless defined otherwise, all technical and scientific terms used herein have the same meaning as commonly understood by one of ordinary skill in the art to which the invention pertains. Although a number of materials and methods similar or equivalent to those described herein can be used in the practice of the present invention, the preferred materials and methods are described herein.

In the application, effective amounts are generally those amounts listed as the ranges or level of ingredients in the descriptions, which follow hereto. Unless otherwise stated, amounts listed in percentage ("%'s") are in volume percent (based on 100% active) of the cleaning composition including the substrate weight. Each of the noted cleaner composition components and substrates is discussed in detail below.

The present invention is directed to a hard surface cleaning composition composed of at least 99.95% natural ingredients and which is environmentally safe and hypoallergenic. Said composition may exist in a plurality of embodiments for the purpose of cleaning different types of surfaces or for the purpose of creating different scents.

The first embodiment of the present invention is directed to a natural glass cleaner with eucalyptus, aloe and rosemary for use on glass surfaces. The essential ingredients of the composition are present according to the follow percentages by volume of the composition:

White Vinegar: 0.25 to 0.75%

Natural Aloe Vera Gel: 0.15 to 0.35%

Fresh Rosemary: 0.5 to 1%

Pure Eucalyptus Oil: 0.015 to 0.035%

Lauryl Glucoside: 0.015 to 0.035%

Dye or Colorant: 0.005 to 0.01%

Preservative: less than 0.05%

Filtered Water: 98 to 99.245%

The second embodiment of the present invention is directed to a natural glass cleaner with rosemary and jasmine for use on glass surfaces. The essential ingredients of the composition are present according to the following percentages by volume of the composition:

Natural Essential Rosemary Oil: 0.005 to 0.01%

Natural Essential Jasmine Oil: 0.005 to 0.01%

Lauryl Glucoside: 0.015 to 0.035%

Dye or Colorant: 0.005 to 0.01%

Preservative: Less than 0.05%

Filtered Water: 99.93 to 99.965%

The third embodiment of the present invention is directed to a natural glass cleaner with lavender, aloe and rosemary for use on glass surfaces. The essential ingredients of the composition are present according to the following percentages by volume of the composition:

White Vinegar: 0.015 to 0.035%

Fresh Aloe Vera Gel: 0.015 to 0.035%

Fresh Rosemary: 0.05 to 0.25%

Natural Lavender Oil: 0.025 to 0.05%

Lauryl Glucoside: 0.015 to 0.035%

Preservative: Less than 0.05%

Filtered Water: 99.6 to 99.885%

A fourth embodiment of the present invention is directed to a natural scrub wash multi-purpose cleaner for use on hard surfaces. The essential ingredients of the composition are present according to the following percentages by volume of the composition:

Lemon Juice: 1 to 2%

Fresh Rosemary: 2.5 to 3.5%

Lauryl Glucoside: 1 to 2%

Fresh Peppermint: 0.5 to 1%

Preservative: less than 0.05%

Filtered Water: 92 to 95.5%

The fifth embodiment of the present invention is directed to a natural shine furniture cleaner with eucalyptus. The essential ingredients of the composition are present according to the following percentages by volume of the composition:

Lemon Juice: 2.5 to 3%

Extra Virgin Olive Oil: 1.5 to 2%

Pure Orange Oil: 0.5 to 1%

Pure Lemon Oil: 0.5 to 1%

Pure Eucalyptus Oil: 0.5 to 1%

Preservative: less than 0.025%

Filtered Water: 91 to 92.5%

The sixth embodiment of the present invention is directed to a natural shine furniture cleaner with lavender. The essential ingredients of the composition are present according to the following percentages by volume of the composition:

Lemon Juice: 5 to 6%

Extra Virgin Olive Oil: 2.5 to 3%

Natural Essential Lavender Oil: 0.5 to 1%

Preservative: Less than 0.025%

Filtered Water: 90 to 92%

In use, the all natural cleaning composition is sprayed from a container onto the desired surface and then wiped with a fabric cloth or paper towel. The surface should be wiped until shined and/or cleaned and until all composition has been lifted from the surface.

While the composition of the present invention has been described and exemplified according to several preferred embodiments thereof, it is recognized that departures from the instant disclosure are fully contemplated within the spirit and scope of the invention which is not to be limited except as defined in the following claims as interpreted under the Doctrine of Equivalents.

What is claimed is:

1. A hard surface cleaning composition comprising:

a. white vinegar in an amount of between 0.015% and 0.75% by volume of the composition;

b. natural aloe vera gel in an amount of between 0.015% and 0.35% by volume of the composition;

c. fresh rosemary in an amount of between 0.05% and 1% by volume of the composition;

d. pure eucalyptus oil in an amount of between 0.015% and 0.035% by volume of the composition;

e. lauryl glucoside in an amount of between 0.015% and 0.035% by volume of the composition; and f. water.

2. The composition as recited in claim 1, further comprising dyes, colorants, and preservatives.

3. The composition as recited in claim 2, wherein the dyes, colorants and preservatives are all natural.

4. The composition as recited in claim 1, wherein the composition is intended for application to glass surfaces for cleaning the glass surfaces.

5. A hard surface cleaning composition comprising:

a. natural essential rosemary oil in an amount of between 0.005% and 0.01% by volume of the composition;

b. natural essential jasmine oil in an amount of between 0.005% and 0.01% by volume of the composition;

c. lauryl glucoside in an amount of between 0.015% and 0.035% by volume of the composition; and d. water.

6. The composition as recited in claim 5, further comprising dyes, colorants, and preservatives.

7. The composition as recited in claim 6, wherein the dyes, colorants, and preservatives are all natural.

8. The composition as recited in claim 5, wherein the composition is intended for application to glass surfaces for cleaning the glass surfaces.

9. A hard surface cleaning composition comprising:

a. lemon juice in an amount of between 1% and 2% by volume of the composition;

b. fresh rosemary in an amount of between 2.5% and 3.5% by volume of the composition;

c. lauryl glucoside in an amount of between 1% and 2% by volume of the composition;

d. fresh peppermint in an amount of between 0.5% and 1% by volume of the composition; and e. water.

10. The composition as recited in claim 9, further comprising dyes, colorants, and preservatives.

11. The composition as recited in claim 10, wherein the dyes, colorants, and preservatives are all natural.

12. A hard surface cleaning composition comprising:

a. white vinegar in an amount of between 0.015% and 0.75% by volume of the composition;

b. natural aloe vera gel in an amount of between 0.015% and 0.35% by volume of the composition;

c. fresh rosemary in an amount of between 0.05% and 1% by volume of the composition;

d. natural lavender oil in an amount of between 0.025% and 0.05% by volume of the composition;

e. lauryl glucoside in an amount of between 0.015% and 0.035% by volume of the composition; and f. water.

* * * * *